US007024990B1

(12) United States Patent
Kaarakka et al.

(10) Patent No.: US 7,024,990 B1
(45) Date of Patent: Apr. 11, 2006

(54) CALENDER AND AN ARRANGEMENT FOR FASTENING ROLLS OF A CALENDER

(75) Inventors: Heikki Kaarakka, Jokela (FI); Seppo Palonen, Jokela (FI); Ville Tiistola, Helsinki (FI); Petteri Kokkonen, Helsinki (FI); Markus Laitila, Järvenpää (FI); Esa Keskinen, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 240 days.

(21) Appl. No.: 10/110,296

(22) PCT Filed: Oct. 12, 2000

(86) PCT No.: PCT/FI00/00885

§ 371 (c)(1),
(2), (4) Date: Apr. 10, 2002

(87) PCT Pub. No.: WO01/27389

PCT Pub. Date: Apr. 19, 2001

(30) Foreign Application Priority Data

Oct. 13, 1999 (FI) ..... 19992214

(51) Int. Cl.
*B21B 27/00* (2006.01)

(52) U.S. Cl. ..... 100/161; 100/163 R; 100/169; 100/331; 100/334

(58) Field of Classification Search ..... 100/155 R, 100/158 R, 159, 161, 162 R, 163, 168–170, 100/176, 331, 334
See application file for complete search history.

(56) References Cited

U.S. PATENT DOCUMENTS

| | | | | |
|---|---|---|---|---|
| 3,270,664 | A * | 9/1966 | Veneman et al. | 100/162 R |
| 3,584,570 | A * | 6/1971 | Sass et al. | 100/163 R |
| 4,211,165 | A * | 7/1980 | Schill | 100/162 R |
| 4,375,188 | A | 3/1983 | Leiviskä | 100/162 |
| 4,915,026 | A | 4/1990 | Halme | 100/62 |
| 5,850,785 | A | 12/1998 | Vallius | 100/35 |

FOREIGN PATENT DOCUMENTS

| | | |
|---|---|---|
| CA | 2117970 | 4/1995 |
| DE | 44 34 509 A1 | 4/1995 |
| EP | 0 666 367 A1 | 8/1995 |

* cited by examiner

*Primary Examiner*—Derris H. Banks
*Assistant Examiner*—Shelley Self
(74) *Attorney, Agent, or Firm*—Cohen, Pontani, Lieberman & Pavane

(57) ABSTRACT

A calender and an arrangement for mounting calender rolls, the calender comprising at least two calender nips (1, 2) formed by at least two stacked rolls (11–14). The rolls are have bearing housings (3–6) by means of which the rolls (11–14) are stacked into roll pairs forming the calender nips (1, 2), and means (31, 32) connecting the bearing housings (3, 4 and 4, 5) of the rolls pairs with each other. At least two successive calender nips (1, 2) are arranged so that in the successive nips the mutual distance between the longitudinal axes of the lower rolls (12, 14) is smaller than the corresponding mutual distance between the respective upper rolls (11, 13) of the nips, whereby the disposition of the rolls (11–14) forms a V-shaped angle as seen from the end of the calender machinery and thus forms an operating area between the nips for changing the rolls. The rolls are combined into nips advantageously using heatable pull rods inserted through the bearing housings.

25 Claims, 8 Drawing Sheets

CALENDER AND AN ARRANGEMENT FOR FASTENING ROLLS OF A CALENDER

PRIORITY CLAIM

This is a national stage of PCT application No. PCT/FI00/00885, filed on Oct. 10, 2000. Priority is claimed on that application and on patent application No. 19992214 filed in Finland on Oct. 13, 1999.

FIELD OF THE INVENTION

The present invention relates to a calender for surface-treating a moving web of paper or board.

The invention also relates to a construction suited for mutual mounting of calender rolls.

BACKGROUND OF THE INVENTION

Different types of calenders are used for improving the smoothness and surface profile of manufactured sheet of paper or board. One of the concurrent calender types is the soft-nip calender comprising at least two calender nips operating in succession along the sheet travel, whereby each nip is formed by a soft roll and a hard roll mounted to rotate on each other. Today, the soft roll is generally surfaced with a polymer coating, while the hard roll is a heatable roll made from cast iron. The different types of rolls are mounted as an alternating succession in a vertical stack thus forming successive nips, whereby either side of a running web travels alternately over a soft roll, a hard roll and so on, thus making both sides of the sheet maximally equal after the surface-treatment. The calender rolls, particularly the soft roll, undergo wear during the use, thereby invoking a need of scheduled replacement. Today, two different techniques of roll replacement are used. In one arrangement, the old roll with its bearing housings is elevated away from its operating position by means of an overhead hoist. Herein, either the upper roll must always be removed before the lower roll can be replaced or, alternatively, the roll stacks must be askewed from a vertical plane in order to facilitate a sideways obliquely performed lifting of the lower roll away from its normal position under the upper roll. Also in vertically aligned roll stacks it is possible to implement the removal of the lower roll to take place in a sideways direction by first shifting the lower roll laterally away from under the upper roll. In this type of a construction, the frame of the calender stack must be open at least in the direction of the lower roll removal.

When the construction is such as to allow the lower roll to be removed only after the removal of the upper roll, the roll replacement operation becomes extremely clumsy, particularly if the upper roll is a heatable roll, as is the case inevitably always for the second nip, because the roll connections such as those of the heating medium circulation must be disconnected during the removal of the roll. In a roll replacement system with a sideways shifting arrangement of the rolls, sufficient free space must be reserved for the movement of either roll. Such servicing space for roll replacement requires more footprint about the calender. As the roll diameters in modern papermaking machines are large, the headroom for roll replacement may be as large as two meters per roll and, since a calender always has at least two calender nips, the need of lateral footprint may be up to four meters for a two-nip calender. Obviously, this kind of roll mounting is not possible in such machinery rebuild operations wherein a soft-nip calender must be fitted to replace an outdated machine calender. During machinery rebuild, it may be necessary to relocate various units of the papermaking machinery and increase the length of the machine, which is expensive. Also in new factory projects, a machine of a larger overall length increases costs due to larger footprint, among other factors. Another drawback of a large lateral roll change space is that the web must travel as open draw over the roll change space, because this portion of machinery cannot be equipped with auxiliary devices. Long, open web draws increase the risk of web breaks and complicate web tail threading.

It is also possible to replace the lower roll of a calendar nip by way of elevating the upper roll apart from the lower roll and then moving the lower roll with its bearing housings aside supported by a roll transfer carriage, whereupon the roll can be replaced. This arrangement is hampered by the large lateral space required about the roll and its need for a dual set of roll handling equipment, whereby the lift must be complemented with at least two transfer carriages, which makes this construction costly.

Attempts have been made to reduce the space requirement of the calender in the machine direction of the web travel by way of, e.g., locating the calender frames of two successive roll nips, the frames having one open side, in a back-to-back disposition of the frames by their closed sides, whereby the web travel between the successive nips is maximally minimized. While this arrangement needs a smaller layout footprint, a problem arises from the roll replacement operations that now must be performed on opposite sides of the calender frame thus still needing as much roll change headroom as in any other conventional calender.

SUMMARY OF THE INVENTION

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

It is an object of the present invention to provide an entirely novel type of calender construction capable of overcoming the problems of the prior art techniques described above.

The goal of the invention is achieved by way of disposing two successive calender nips so that the mutual distance between the lower rolls of the successive nips is smaller than the mutual distance between the upper rolls of the nips, whereby the rolls of the nips as seen from their ends are disposed in a V-shaped configuration.

Herein, the calender rolls can be connected to each other by means of pull rods adapted to connect the roll bearing housings to each other, whereby the connections to the auxiliary devices of the roll may be adapted into the roll stack so as form an integrated auxiliary equipment assembly.

The invention offers significant benefits.

By virtue of the invention, it is possible to gain a substantial reduction in the footprint occupied in the machine direction by a calender such as a soft-nip calender or the like comprising a plurality of separate roll nips.

The invention also facilitates a simple replacement of the lower rolls. The calender framework becomes extremely uncomplicated and lightweight, because the roll bearing housings are connected to each other so that the nip forces are not transmitted to the framework. Now, since the calender framework is relieved from high forces imposed thereon by the roll nips, also the calender foundations are not subjected to high stresses. Hence, a calender according to the invention is aptly suited for machine rebuilds intended, e.g., to improve the quality of the manufactured product with the help of a more efficient calender. A calender according to the invention may even be fitted to replace a single-stack machine calender in places where prior-art calender constructions could not necessarily be squeezed onto the footprint left free by a dismantled two-stack machine calender. Furthermore, the length of open web draws remains short and the number of guide rolls is smaller than in conventional calender constructions. The bearing housings of any roll pair forming a nip are connected to each other by techniques that in an uncomplicated and precise manner give the required roll fixing force also for the upper rolls, and there are provided transfer and support means for the auxiliary devices operating between the calender nips so as to permit the displacement of these devices for the time the lower rolls are being replaced. The fluid, electrical and other connections of the rolls and their auxiliary means are concentrated at the roll ends and enclosed therein, whereby the connections have enough headroom so that there is no need to disconnect them from the rolls being replaced. It is even possible to design the entire calender into an integrated unit that can be shipped to a customer and rapidly mounted on site as a replacement of an existing calender or as a part of new machinery being erected.

BRIEF DESCRIPTION OF THE DRAWINGS

In the following, the invention will be examined with the help of exemplifying embodiments and by making reference to the appended drawings in which.

DETAILED DESCRIPTION OF THE PRESENTLY PREFERRED EMBODIMENTS

Figure 1:
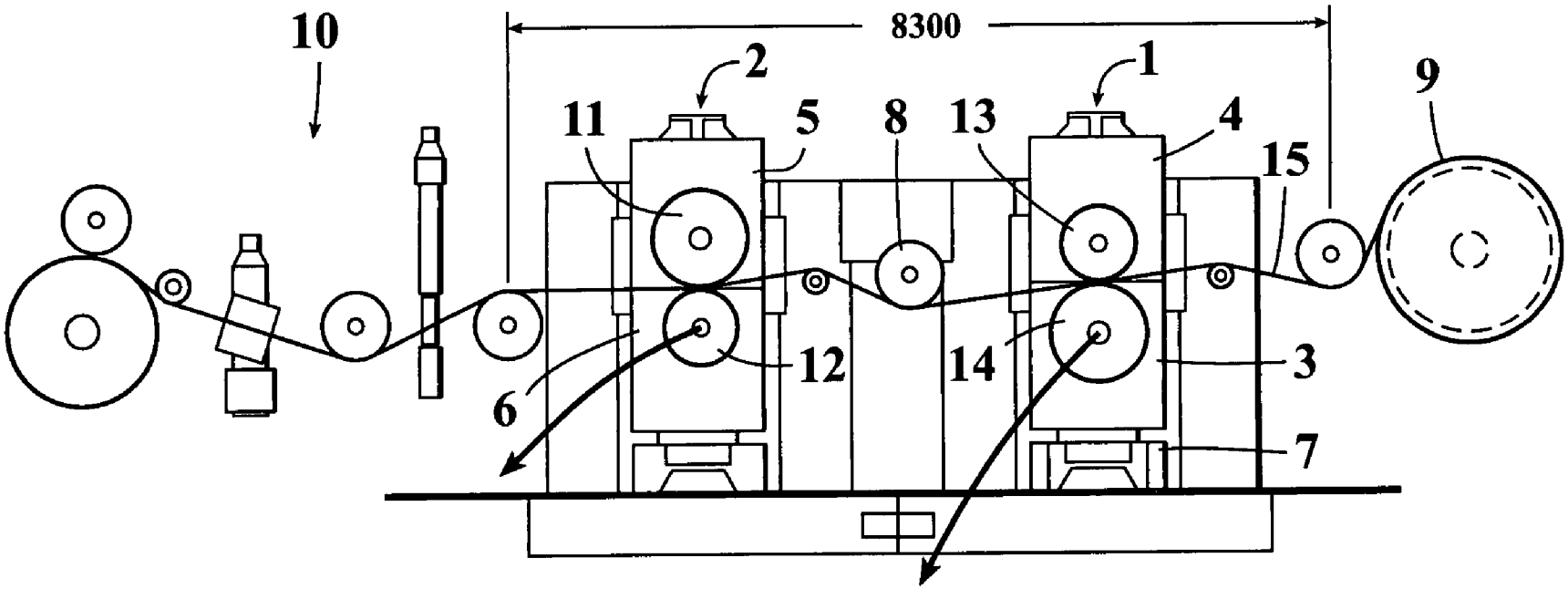
FIG. 1 shows a conventional calender construction.

Referring to FIG. 1, the calender construction shown therein has bearing housings 3–6 of rolls 11–14 connected to each other and the roll nips 1 and 2 have separate frames. A web 15 enters a first roll nip, e.g., from an unwinder 9 and then travels from first a nip 1 to a second nip 2 over a guide/spreading roll 8. Next downstream from the calender is located a set of measurement equipment 10 and guide rolls that pass the web 15 to the subsequent treatment stage such as a winder. Under each one of the bearing housings 3, 6 of the lower roll 12, 14 of either roll nip 1, 2 is disposed a roll change carriage 7, and the roll change is performed by way of first detaching the bearing housings 3, 4 and 5, 6, respectively, from each other, then elevating the upper bearing housing upward and lowering the lower bearing housing onto the roll change carriage 7 and subsequently moving the same clear from below the upper roll, thus allowing the roll to be changed at the side of the calender. In this exemplifying case, the machine-direction length of the calender is 8300 mm, which can hardly be made shorter, because guide or spreading rolls are necessarily needed between the calender nips 1, 2, as well as in front of them and after them.

Figure 2:
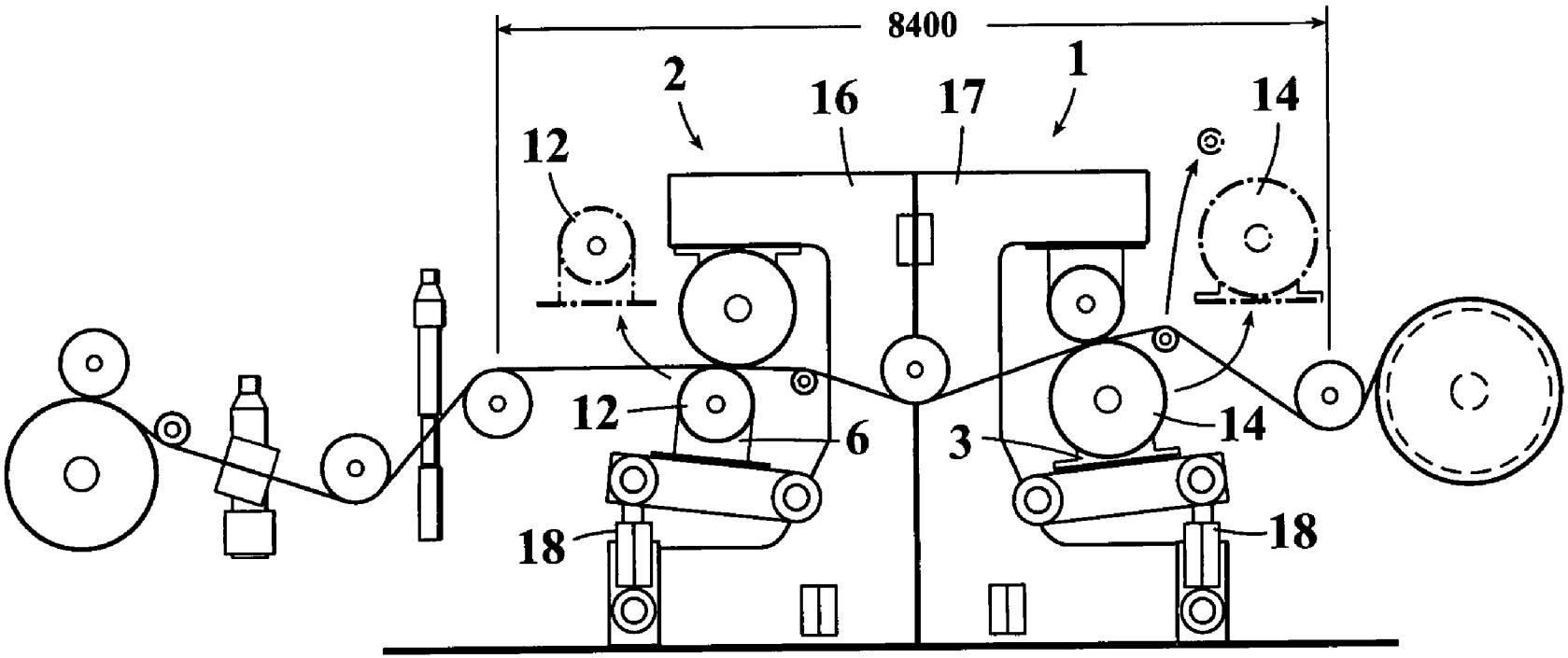
FIG. 2 shows another conventional calender construction.

In the embodiment of FIG. 2, C-shaped frames 16, 17 of the calender nips 1, 2, respectively, are disposed back-to-back, and the bearing housings 3, 6 of the lower rolls 12, 14, respectively, are mounted supported on hydraulic cylinders 18, thus allowing the housings during the roll change operation to be lowered downward and then moved out of way past the frames 16, 17. Inasmuch the rolls 12, 14 may have a very large diameter, the operating space on both sides of the frame must be made wide, up to 2 m, in order to perform an unobstructed lift of the calender rolls. Not even this arrangement can make the calender machine-direction length shorter than the referenced dimension of 8400 mm. Furthermore, the nip forces are imposed on the open frame of the roll nips that accordingly must be made very rigid and massive.

Figure 3:
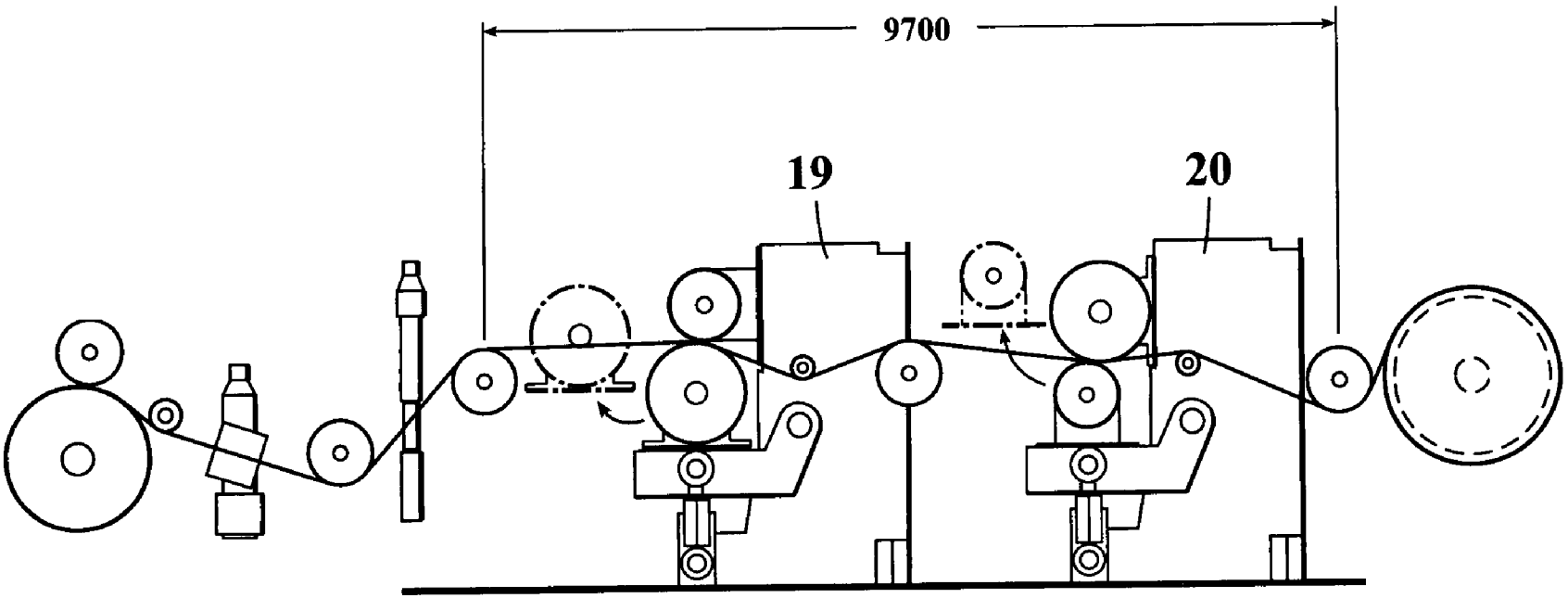
FIG. 3 shows a third conventional calender construction.

In the embodiment of FIG. 3, the frames 19, 20 are oriented in the same direction. This arrangement is the most wasteful in terms of footprint usage and, consequently, in many cases the most expensive to implement giving a reference dimension of 9700 mm for the length of this type of calender that, as is evident from the diagram, can hardly be made shorter. It must be noted herein that, since the reference dimensions given above represent those of the exemplifying embodiments, actually required operating space is ultimately determined by the basic dimensions of the machinery such as roll diameters.

Figure 4:
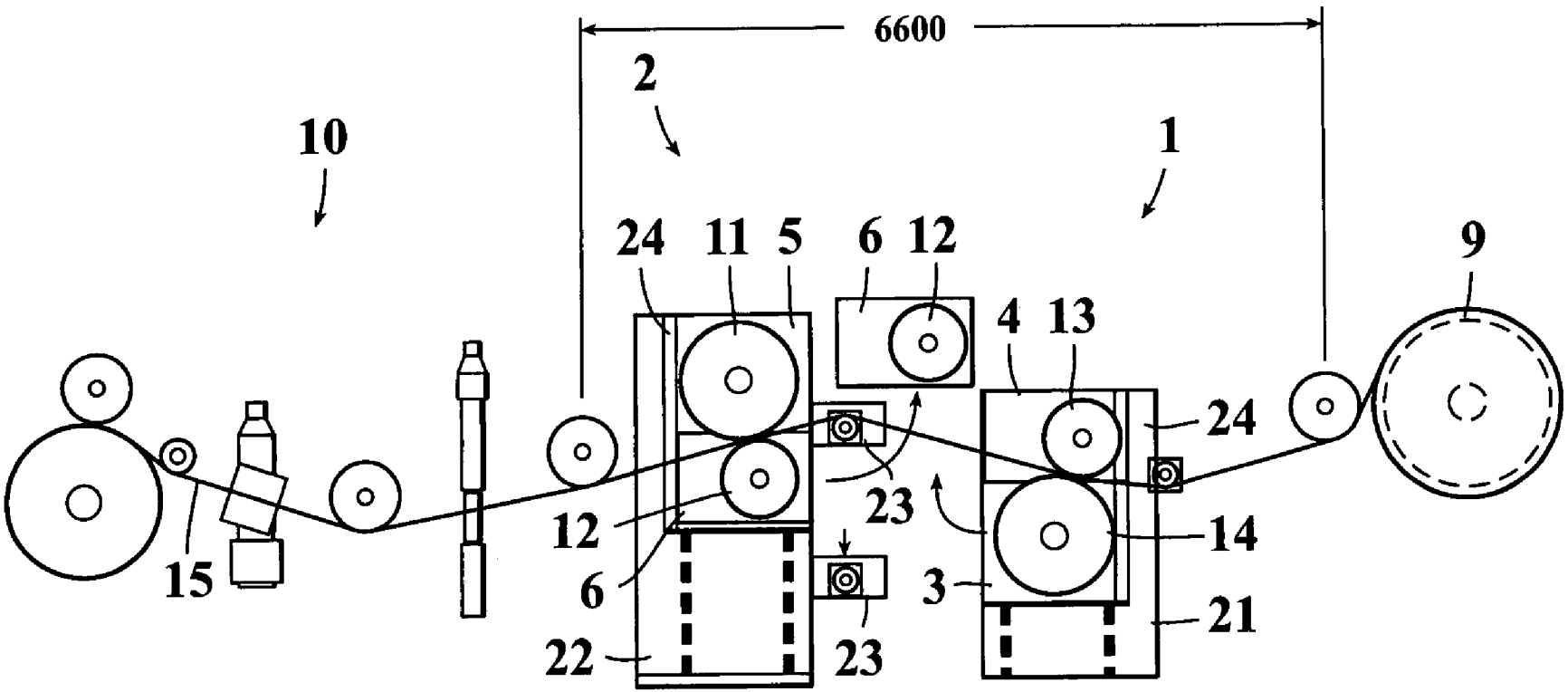
FIG. 4 shows schematically an embodiment of the calender construction according to the invention.

In FIG. 4 is shown a schematic view of an embodiment according to the invention. In this construction, the bearing housings 3–6 of the calender rolls 11–14 are mounted on lightweight frames 21, 22. Additionally, the bearing housings 3–6 are connected to each other so that the nip forces are not transmitted to the frames 21, 22 of the calender nips 1, 2. The rolls 11, 12 and 13, 14 of either calender nip 1, 2, respectively, are arranged in a mutually laterally displaced position so that the longitudinal axes of the stacked rolls are not located in the same vertical plane. The calender frames 21, 22 are adapted in a facing disposition so that the mutual distance between the longitudinal axes of the lower rolls of the roll nips is smaller than the corresponding mutual distance between the upper rolls of the nips, whereby the disposition of the rolls form a V-shaped angle as seen from the end of the calender machinery. This disposition allows the operating area for changing the lower rolls to be adapted between the opposed calender nips 1, 2 thus disposing with the need for two separate roll change areas. In the illustrated exemplifying embodiment, each calender nip comprises a soft roll 11, 14 and a heatable hard roll 12, 13 that forms a nip with its respective soft roll.

Figure 5:
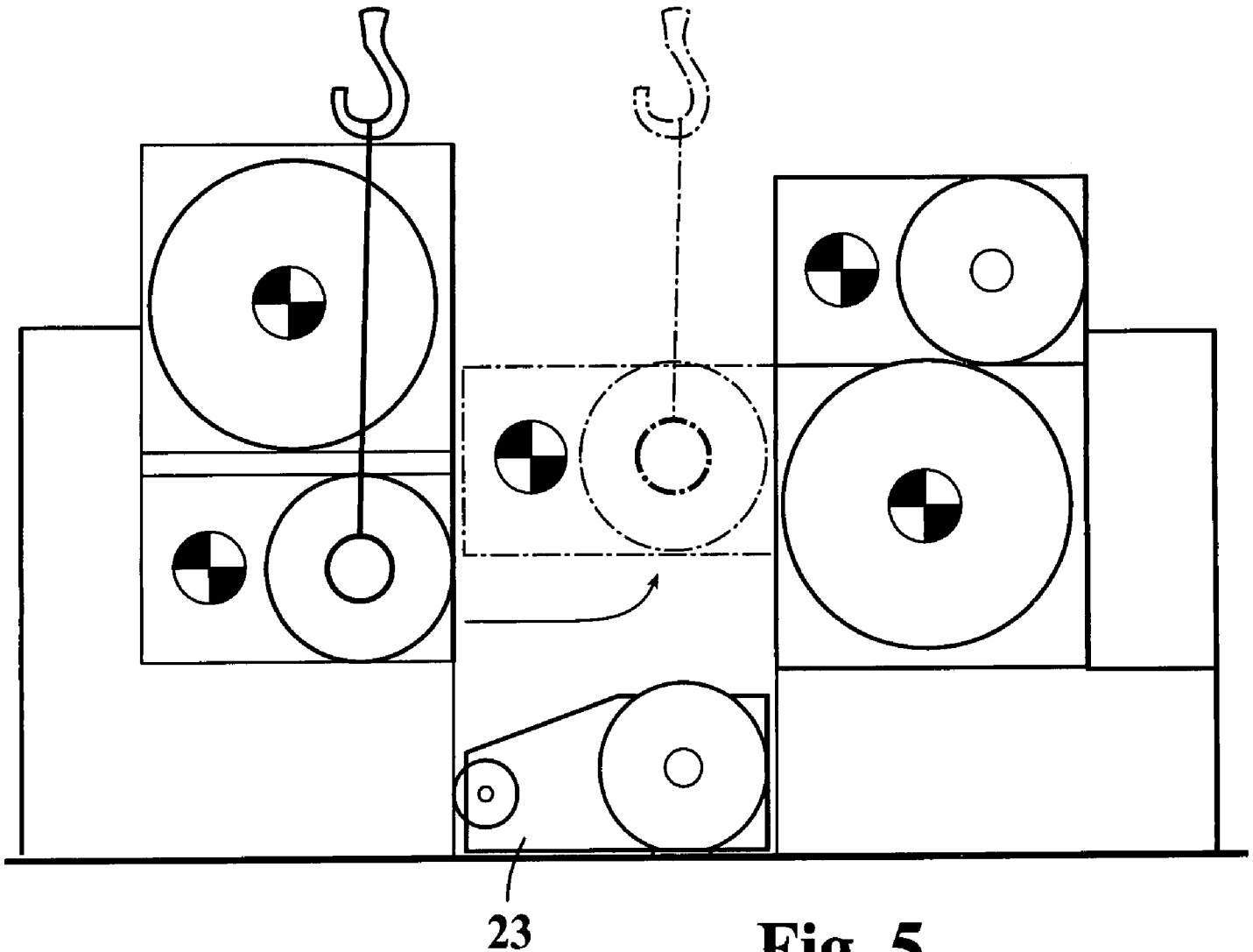
FIG. 5 shows schematically the roll replacement operation in the calender embodiment of FIG. 4.

For changing the rolls, the calender according to the invention is complemented with some auxiliary means. The bearing housings 4, 5 of the upper rolls 11, 13 are mounted on guides 24 which are fixed to the frames 21 and 22 and along which the bearing housings can be slidably elevated upward away from their superimposed location above the bearing housings 3, 6 of the lower rolls 12, 14. Obviously, the guides 24 may be replaced by any other similar guidance means. The intervening units between the calender nips, such as rolls, a steam box, measurement equipment or other possible auxiliary devices can be advantageously combined into an integrated assembly 23 that is mounted to the upper roll bearing housing 5 by aligning the assembly with a keyed connection and then fixing it in place by means of bolts. Alternatively, the assembly with its auxiliary devices can be mounted on the lower roll bearing housing. In the exemplifying embodiment shown in FIGS. 4 and 5, the assembly includes only one roll. Obviously, the assembly can be integrated to include any necessary auxiliary devices with their electrical, fluid and compressed-air connections so dimensioned that the assembly can be lowered below the lower rolls, between the calender nips, for the duration of a roll change. The integrated auxiliary equipment assembly 23 can be lowered to rest on fixing means adapted to the calender frame 22 as shown in FIG. 4 or, alternatively, onto the floor as shown in FIG. 5.

In this calender embodiment, the change of the upper rolls 11, 13 can be made simply by using a lift for elevating the roll away from its operating position above the lower roll bearing housing. The lower rolls 12, 14 are changed by way of disconnecting the bearing housings from each other and then lifting the upper rolls 11, 13 upward along the guides 24. Next, the bearing housings 3, 6 of the lower rolls 12, 14 are detached from the frames 21, 22, whereupon the rolls can be transferred by a lift away from the lift area remaining between the calender nips 1, 2. Prior to the lifting of the lower rolls and, advantageously, before the bearing housings are detached, the auxiliary equipment assembly 23 is detached and lowered down to keep it clear from the transfer path of the lower rolls. Obviously, the installation of a new roll takes place in a reverse order. To assure fast roll replacement, it is essential to have the connections of the upper rolls 11, 13 and the auxiliary equipment assembly 23 implemented with such dimensioning rules that these units need not be dismantled when these units must be moved aside.

Figure 6:
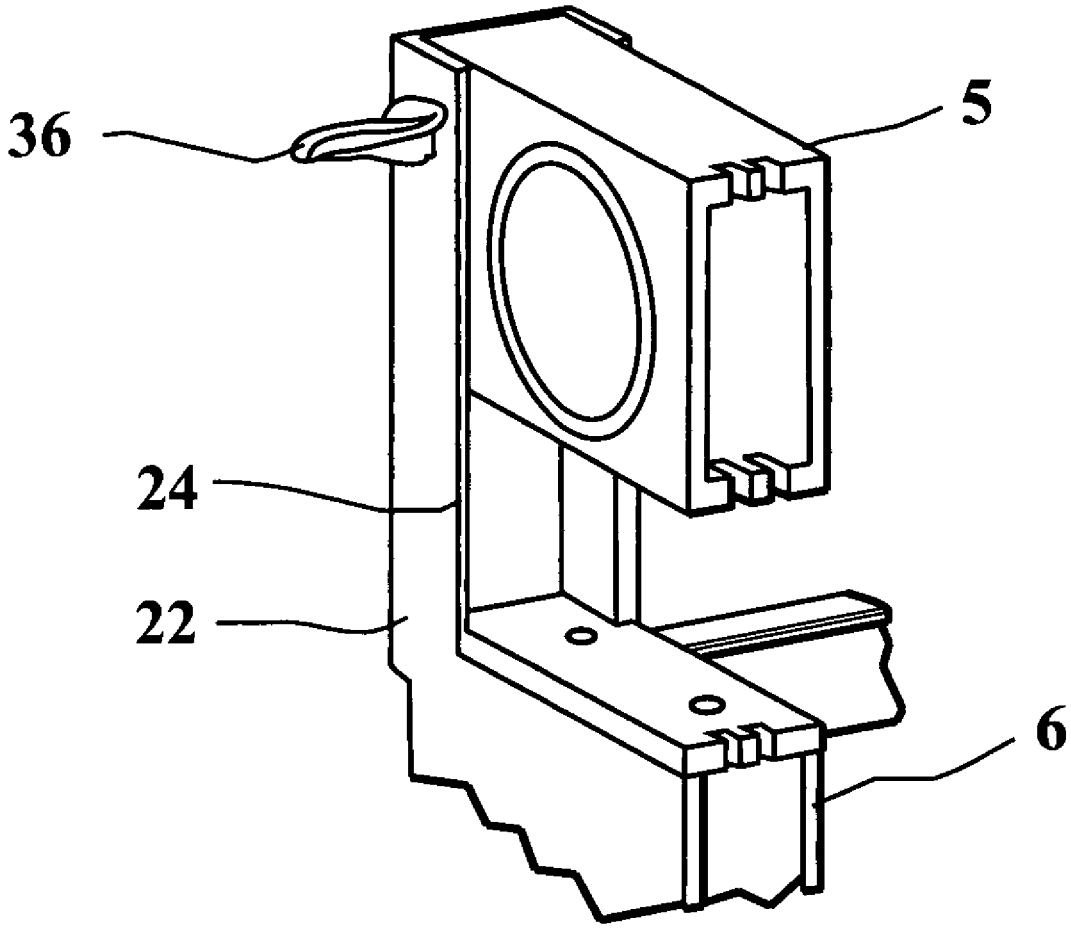
FIG. 6 shows schematically the roll replacement operation in the calender embodiment of FIG. 4 when the lower roll is already removed.

In FIG. 6 are shown the details related to the roll change operation and the construction of the calender frame and its bearing housings. Herein, the frame 22 has a box-section structure in which the waist plates of the frame form a U-section in which the sides act as guide surfaces 24 for the movement of the upper bearing housing 5. In the diagram, the upper bearing housing 5 is shown elevated into its upper position for the duration of the roll change. The bearing housing 5 is supported to the frame 22 by means of a pin 36 fitted into a hole made to the frame.

The lower roll is replaced as follows. First, the auxiliary equipment assembly 23 situated in front of the nip is detached from the bearing housings 5, 6 and is lowered below the lower roll without any need to dismantle its connections, whereupon the bearing housings 5, 6 can be disconnected from each other. The upper roll is elevated upward under the guidance provided by the guide surfaces 24 formed on the frame 22 and is locked in place by way of, e.g., pushing a pin 36 either manually or by actuator means through the holes made to the upper part of the frame 22 and the upper part of the bearing housing 5. Resultingly, the upper roll remains resting on the pin supported by the bearing housing 5 so that the lower edge of the bearing housing 5 leans against the frame 22. The connections of the upper roll must be designed such that they permit lifting the roll into its locked position during roll change without any need for dismantling the connections. Hereafter, the lower roll bearing housings 6, as well as the connections of the roll and the mechanical drive shaft thereof, are detached from the frame 22. If there are any auxiliary devices located in front of the lower roll, such as a cleaning doctor, the auxiliary devices are rotated aside clear of the roll change transfer path either manually or using powered actuators. Subsequently, the lower roll with its bearing housings 6 can be elevated away from the area remaining between the roll nips. Obviously, the installation of a new roll takes place in a reverse order.

As mentioned earlier, the present invention relates to calender constructions in which the bearing housings of the calender rolls are connected to each other. The required nip force as well as the opening and closing of the nip are implemented by means of a mechanism acting on a deflection-compensated roll; whereby the calender frame receives only a minimal portion of the reactive forces resulting from the actuation of the nip pressure. To achieve a fast and reliable roll change and, above all, easy installation of a new roll, the connection of bearing housings to each other must be designed to be uncomplicated and such that it gives a sufficiently large and very accurately correct nip force. Obviously, the embodiment must also assure an accurate alignment of the bearing housings.

Figure 7:
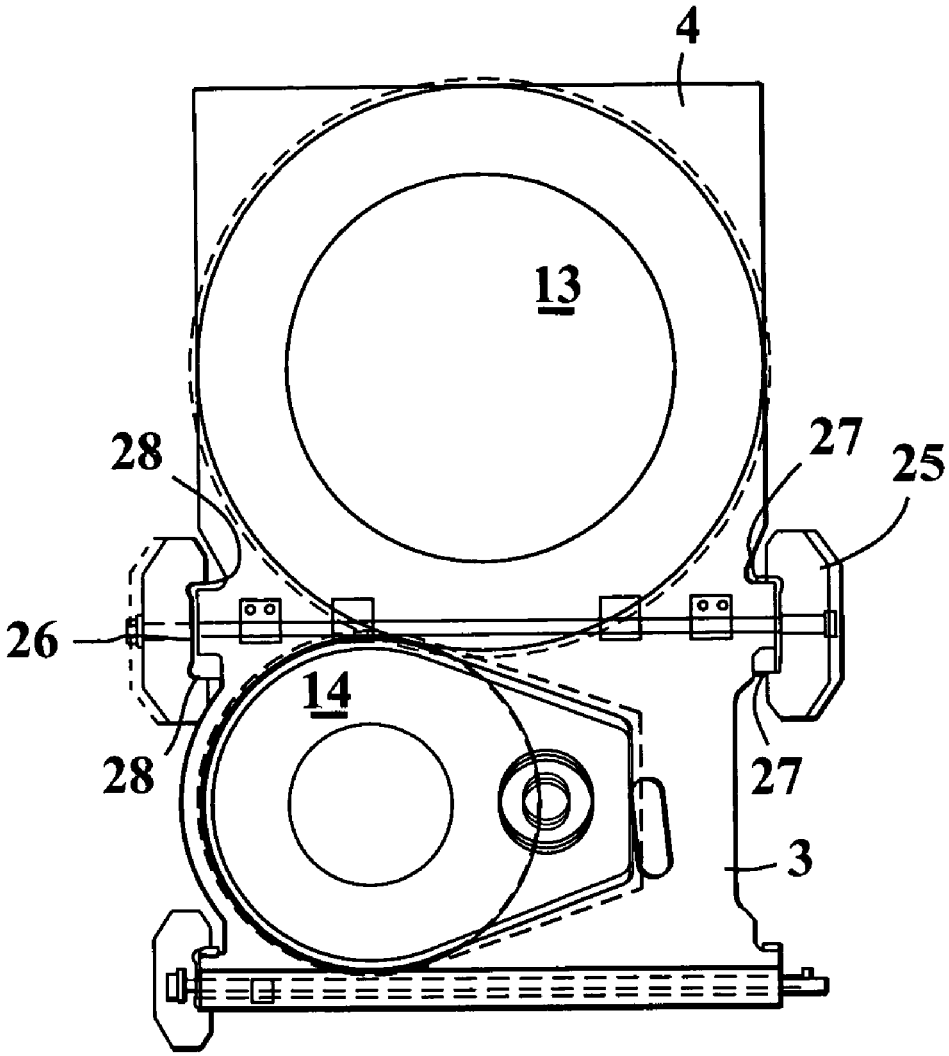
FIG. 7 shows in a side view one mounting technique of calender bearing housings.
Figure 8:
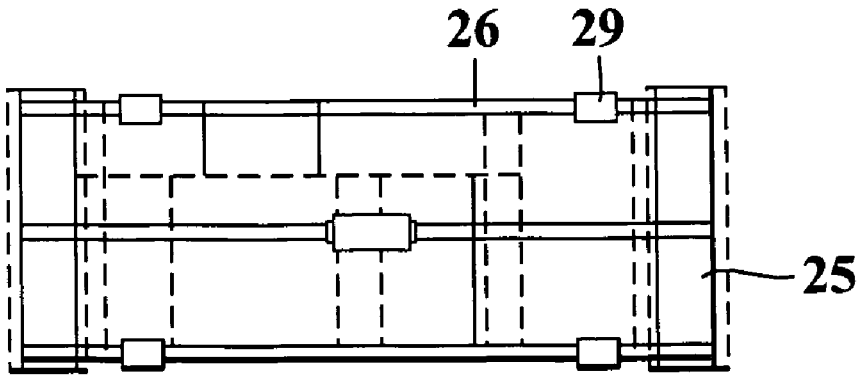
FIG. 8 shows in a top view the arrangement of FIG. 7.

In FIGS. 7 and 8 is shown one method for a reliable connection of the bearing housings 3, 4 to each other. In this embodiment, the bearing housings are provided with planar or wedge-shaped clamping surfaces 27, whereby the bearing housings can be clamped together against each other by means of clamp members 25 that are in a compatible manner provided with wedge-shaped or planar surfaces 28. The clamp members are C-shaped and have their clamping surfaces on the inner sides of the shaped member. The wedged contact between the clamping surfaces 27 of the clamp member and the respective projections of the bearing housings can be implemented by way of using a wedged shape on both or only one of the opposed clamping surfaces. The clamp members 25 are made so wide as to extend over the entire width of the bearing housings, whereby they are pressed against the sides of the bearing housings by means of tensioning bolts 26 that connect the clamp members located on the opposite sides of the bearing housings to each other and thus press the clamp members 25 against the side surfaces 27 of the clamping projections of the bearing housings. In the illustrated embodiment, the tensioning bolts 26 are disposed at the sides of the bearing housings and to ease their insertion, the upper bearing housing 4 is provided with bolt support guides 29 through which the bolts are passed. When the tensioning bolts are tightened with a given torque, the bearing housings are compressed against each other at a given force. This mounting method is fast and reliable, yet needing less space in the machine direction than a conventional mounting technique using bolts. The illustrated mounting method permits an extremely rapid roll replacement in the calender according to the invention and, hence, this mounting arrangement is also advantageously used for connecting the lower bearing housing 3 to the calender frame.

Figure 9:
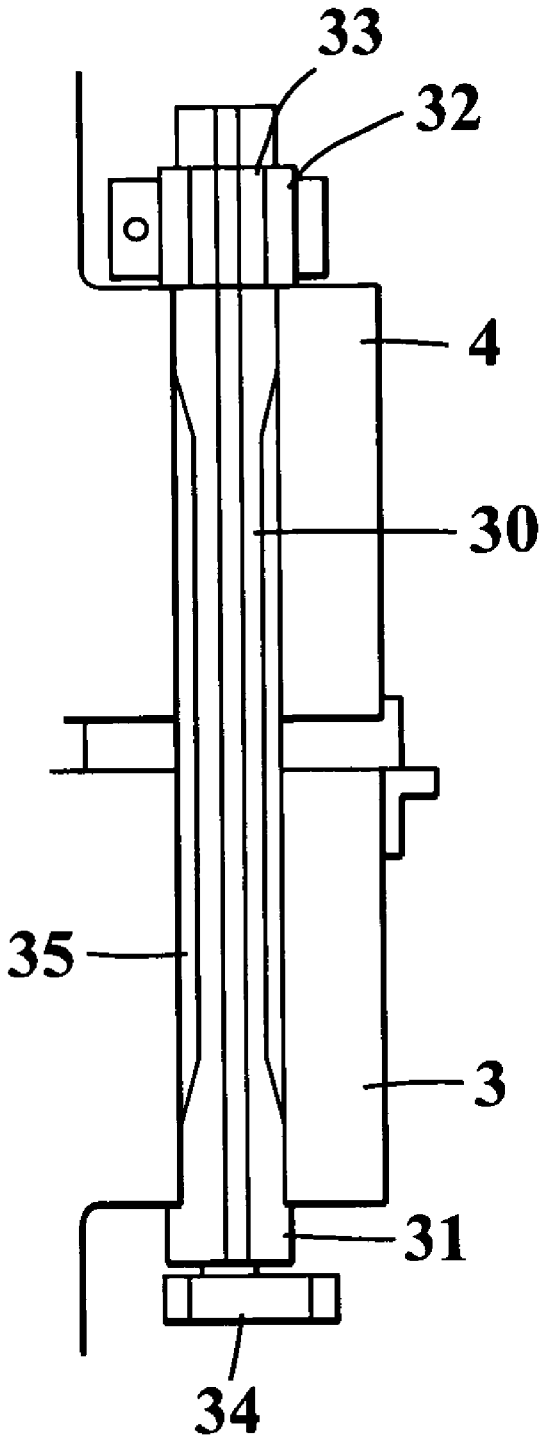
FIG. 9 shows another mounting technique of calender bearing housings.

In FIG. 9 is shown an alternative method of mounting the bearing housings 3, 4. Herein, into mounting holes 35 drilled to the bearing housings 3, 4 are inserted pull rods 30, each of them having an electrical heater element 34 removably or fixedly adapted into its center bore. The lower end of the pull rod has a collar projection 31 adapted to rest against the edge of the mounting hole 35 drilled to the lower bearing housing 3. The upper end of the pull rod 30 has an annular recess 33 capable of accommodating a locking piece 32 that rests against the edge of the mounting hole 35 drilled to the upper bearing housing 4. Obviously, the pull rod 30 may also be inserted into an inverted position. Now, the mounting of the bearing housings takes place by way of inserting the pull rods 30, after they are heated with the help of the heater elements 34, into the mounting holes 35 drilled to the superimposed bearing housings 3, 4, whereby the distance from the proximal edge of the collar projection 31 to the distal edge of the annular recess 33 is thermally extended so much that the locking piece can be inserted between the edge of the mounting hole 35 drilled to the upper bearing housing 4 and the distal edge of the annular recess 33. In other words, the distance from the proximal edge of the locking piece to the proximal edge of the pull rod collar projection at the beginning of the mounting operation is kept larger than the distance between the outer surfaces of the mounting holes 35 drilled to the bearing housings 3, 4. The locking piece 32 may be, e.g., a split ring that is joined with bolts or as well any other conventional locking member. After the locking piece 32 is firmly mounted in the annular recess 33, the heater element 34 is deenergized or pulled out from the pull rod center bore, whereupon the rod begins to contract thus pulling the bearing housings against each other. At the ambient temperature of the calender, the target length of the contracted pull rod defined as the distance between the proximal edges of its locking parts must be shorter than the distance between the outer edge surfaces of the mounting holes drilled to accommodate the pull rods. Under very warm conditions, the ambient temperature may rise as high as 40 to 50° C., while in the machinery halls of cold-climate factories the ambient temperature can be very close to 0° C. Generally, the operating ambient temperature is in the order of 10–30° C.

The connecting force imposed by the pull rods is easy to control to a desired value inasmuch the force generated by a contracting rod can be readily computed. The pull rod is advantageously made from steel whose thermal expansion coefficient is known precisely. Obviously, the rod may be made from any other material of a sufficiently high strength, whereby the above-mentioned locking members 31, 32, 33 can be replaced by nuts having a thread compatible with those made to the rod ends or, alternatively, other locking means can be used capable of accurately positioning the rod in its longitudinal axis direction. Instead of using a heater element, the rod may be heated by other methods such as an oven or a heating bath, but this technique requires a rapid installation sequence during which the rod may not cool down. The electrical heater element can be mounted in a permanent or removable manner.

In addition to the exemplifying embodiments described above, different modifications may be contemplated without departing from the spirit of the invention. While only a soft-nip calender is discussed above as an example of calender types, the invention can as well be applied to all such calenders that include at least two calender nips formed by two rolls. The angle between the inclined roll stacks, that is, the V-angled disposition between the adjacent roll stacks can be varied, however, not making the angle smaller that what is necessary to ensure unobstructed removal of the lower roll from below the upper roll. The required tilt angle between the rolls stacks is determined by such factors as the outer dimensions of the rolls and their bearing housings. Typically, a line drawn through the centers of the upper roll and the lower roll is inclined by 15° in regard to the vertical plane. The number of calender nips may be greater than two, whereby each two calender nip pairs needs two roll change spaces and so upward according to the increasing number of calender nips. The number of rolls in a single assembly of nips may also be larger, whereby a typical arrangement is to use three rolls in a stack. The bearing housings of the calender may be mounted using fixing means different from those described above.

The pull rod arrangement according to the invention is also applicable to single-nip calenders. These types of calenders include, e.g., low-gloss calenders and machine calenders, wherein the peripheral devices of the roll are advantageously integrated into an auxiliary equipment assembly in the manner described above.

Thus, while there have been shown and described and pointed out fundamental novel features of the present invention as applied to a preferred embodiment thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A calender comprising:

at least two successive calender nips each formed by at least two stacked rolls, wherein the calender nips are arranged so that a mutual distance between the longitudinal axes of lower rolls is smaller than a corresponding mutual distance between respective upper rolls of the nips, so that the axes of the rolls as seen from the end of the rolls forms a V-shaped angle, thereby forming an operating area between the nips for changing the rolls;

bearing housings by means of which the rolls are mounted and stacked into roll pairs forming the calender nips; and means for fixedly connecting the bearing housings of each of the roll pairs to each other in pairs.

2. The calender of claim 1, wherein each one of the calender nips has at least one soft roll and at least one heatable hard roll.

3. The calender of claim 1, further comprising at least two frames on which said bearing housings of said rolls are mounted, and means mounted on at least one of said frames for, during a change of one of the lower rolls, supporting the bearing housings of the respective upper roll at a level higher than their normal operating position.

4. The calender of claim 1, wherein connections from at least the upper rolls to electrical, fluid, compressed air and other systems are so dimensioned that the upper rolls can be moved vertically without a need for dismantling the connections by a distance required for a change of the lower roll.

5. The calender of claim 3, wherein connections from at least the upper rolls to electrical, fluid, compressed air and other systems are so dimensioned that the upper rolls can be moved vertically without a need for dismantling the connections by a distance required for a change of the lower roll.

6. The calender of claim 4, further comprising an intervening unit positioned between the calender nips and comprising at least one of a roll, a measurement equipment, and another web handling device, the intervening unit being positioned in a space where a roll is moved when a roll is changed, the intervening unit being mounted on the calender frame in a detachable manner and having connections thereto dimensioned so that the intervening unit can be lowered below the level of the lower rolls without dismantling connections to the intervening unit.

7. The calender of claim 5, further comprising an intervening unit positioned between the calender nips and comprising at least one of a roll, a measurement equipment, and another web handling device, the intervening unit being positioned in a space where a roll is moved when a roll is changed, the intervening unit being mounted on the calender frame in a detachable manner and having connections thereto dimensioned so that the intervening unit can be lowered below the level of the lower rolls without dismantling connections to the intervening unit.

8. The calender of claim 1, wherein said means for fixedly connecting said bearing housings comprises pull rods having locking means adapted thereon so that at an operating temperature a distance between proximal edges of said locking means is shorter than the distance between outer edge surfaces of mounting holes formed in two superimposed bearing housings, and so that when said pull rods are heated the distance between said proximal edges of said locking means becomes larger than said distance between said outer edge surfaces of said mounting holes.

9. The calender of claim 8, wherein a bore is formed in the pull rod so as to accommodate therein a heater element.

10. The calender of claim 9, further comprising a heater element mounted in the bore of the pull rod.

11. The calender of claim 10, wherein the heater element is removably mounted in the bore of the pull rod.

12. The calender of claim 10, wherein the heater element is fixedly mounted in the bore of the pull rod.

13. The calender of claim 1, wherein said means for fixedly connecting said bearing housings comprises at least two clamp pieces having two clamping surfaces that are in an opposed disposition and are spaced apart from one another, wherein said bearing housings have two pairs of compatible clamping surfaces on external sides spaced apart from each other, said two pairs of compatible clamping surfaces being oriented outwardly relative to each other and being shaped to form wedge-shaped mating surfaces in combination with said clamping surfaces of said clamp pieces, said means for fixedly connecting said bearing housings further comprising at least one bolt for compressing said clamp pieces onto said clamping surfaces of said bearing housings.

14. The calender of claim 8, further comprising an intervening unit positioned between the calender nips and comprising at least one of a roll, a measurement equipment, and another web handling device, the intervening unit being positioned in a space where a roll is moved when a roll is changed, the intervening unit being mounted on the calender frame in a detachable manner and having connections thereto dimensioned so that the intervening unit can be lowered below the level of the lower rolls without dismantling connections to the intervening unit.

15. The calender of claim 9, further comprising an intervening unit positioned between the calender nips and comprising at least one of a roll, a measurement equipment, and another web handling device, the intervening unit being positioned in a space where a roll is moved when a roll is changed, the intervening unit being mounted on the calender frame in a detachable manner and having connections thereto dimensioned so that the intervening unit can be lowered below the level of the lower rolls without dismantling connections to the intervening unit.

16. A calender comprising:

at least two successive calender nips each formed by at least two stacked rolls, wherein the calender nips are arranged so that a mutual distance between the longitudinal axes of lower rolls is smaller than a corresponding mutual distance between respective upper rolls of the nips, so that the axes of the rolls as seen from the end of the rolls forms a V-shaped angle, thereby forming an operating area between the nips for changing the rolls;

bearing housings by means of which the rolls are stacked into roll pairs forming the calender nips;

means for mounting the bearing housings of the rolls pairs to each other, wherein connections from at least the upper rolls to electrical, fluid, compressed air and other systems are so dimensioned that the upper rolls can be moved vertically without a need for dismantling the connections by a distance required for a change of the lower roll; and an intervening unit positioned between the calender nips and comprising at least one of a roll, a measurement equipment, and another web handling device, the intervening unit being positioned in a space where a roll is moved when a roll is changed, the intervening unit being mounted on the calender frame in a detachable manner and having connections thereto dimensioned so that the intervening unit can be lowered below the level of the lower rolls without dismantling connections to the intervening unit.

17. A calender comprising:

at least two successive calender nips each formed by at least two stacked rolls, wherein the calender nips are arranged so that a mutual distance between the longitudinal axes of lower rolls is smaller than a corresponding mutual distance between respective upper rolls of the nips, so that the axes of the rolls as seen from the end of the rolls forms a V-shaped angle, thereby forming an operating area between the nips for changing the rolls;

bearing housings by means of which the rolls are stacked into roll pairs forming the calender nips;

means for mounting the bearing housings of the rolls pairs to each other;

at least two frames on which said bearing housings of said rolls are mounted, and means mounted on at least one of said frames for, during a change of one of the lower rolls, supporting the bearing housings of the respective upper roll at a level higher than their normal operating position, wherein connections from at least the upper rolls to electrical, fluid, compressed air and other systems are so dimensioned that the upper rolls can be moved vertically without a need for dismantling the connections by a distance required for a change of the lower roll; and an intervening unit positioned between the calender nips and comprising at least one of a roll, a measurement equipment, and another web handling device, the intervening unit being positioned in a space where a roll is moved when a roll is changed, the intervening unit being mounted on the calender frame in a detachable manner and having connections thereto dimensioned so that the intervening unit can be lowered below the level of the lower rolls without dismantling connections to the intervening unit.

18. A calender comprising:

at least two successive calender nips each formed by at least two stacked rolls, wherein the calender nips are arranged so that a mutual distance between the longitudinal axes of lower rolls is smaller than a corresponding mutual distance between respective upper rolls of the nips, so that the axes of the rolls as seen from the end of the rolls forms a V-shaped angle, thereby forming an operating area between the nips for changing the rolls;

bearing housings by means of which the rolls are stacked into roll pairs forming the calender nips;

means for mounting the bearing housings of the rolls pairs to each other, wherein said means for mounting said bearing housings comprises pull rods having locking means adapted thereon so that at an operating temperature a distance between proximal edges of said locking means is shorter than the distance between outer edge surfaces of mounting holes formed in two superimposed bearing housings, and so that when said pull rods are heated the distance between said proximal edges of said locking means becomes larger than said distance between said outer edge surfaces of said mounting holes.

19. The calender of claim 18, wherein a bore is formed in the pull rod so as to accommodate therein a heater element.

20. The calender of claim 19, further comprising a heater element mounted in the bore of the pull rod.

21. The calender of claim 18, further comprising an intervening unit positioned between the calender nips and comprising at least one of a roll, a measurement equipment, and another web handling device, the intervening unit being positioned in a space where a roll is moved when a roll is changed, the intervening unit being mounted on the calender frame in a detachable manner and having connections thereto dimensioned so that the intervening unit can be lowered below the level of the lower rolls without dismantling connections to the intervening unit.

22. The calender of claim 19, further comprising an intervening unit positioned between the calender nips and comprising at least one of a roll, a measurement equipment, and another web handling device, the intervening unit being positioned in a space where a roll is moved when a roll is changed, the intervening unit being mounted on the calender frame in a detachable manner and having connections thereto dimensioned so that the intervening unit can be lowered below the level of the lower rolls without dismantling connections to the intervening unit.

23. The calender of claim 20, wherein the heater element is removably mounted in the bore of the pull rod.

24. The calender of claim 20, wherein the heater element is fixedly mounted in the bore of the pull rod.

25. The calender of claim 18, wherein said means for mounting said bearing housings comprises at least two clamp pieces having two clamping surfaces that are in an opposed disposition and are spaced apart from one another, wherein said bearing housings have two pairs of compatible clamping surfaces on external sides spaced apart from each other, said two pairs of compatible clamping surfaces being oriented outwardly relative to each other and being shaped to form wedge-shaped mating surfaces in combination with said clamping surfaces of said clamp pieces, said means for mounting said bearing housings further comprising at least one bolt for compressing said clamp pieces onto said clamping surfaces of said bearing housings.

* * * * *